US008959818B2

(12) United States Patent
Mayerl

(10) Patent No.: US 8,959,818 B2
(45) Date of Patent: Feb. 24, 2015

(54) TRIGGER FOR FIREARMS WITH REMOVABLE MAGAZINE

(71) Applicant: Styria Arms—Michael W. Mayerl, Zeltweg (AT)

(72) Inventor: Michael W. Mayerl, Möderbrugg (AT)

(73) Assignee: Styria Arms—Michael W. Mayerl, Zeltweg (AT)

( * ) Notice: Subject to any disclaimer, the term of this patent is extended or adjusted under 35 U.S.C. 154(b) by 0 days.

(21) Appl. No.: 13/974,269

(22) Filed: Aug. 23, 2013

(65) Prior Publication Data

US 2014/0165440 A1 Jun. 19, 2014

(30) Foreign Application Priority Data

Aug. 24, 2012 (DE) ..... 20 2012 008 104 U

(51) Int. Cl.
*F41A 9/55* (2006.01)
*F41A 17/38* (2006.01)
*F41A 19/11* (2006.01)
*F41A 9/00* (2006.01)

(52) U.S. Cl.
CPC ... *F41A 9/00* (2013.01); *F41A 9/55* (2013.01); *F41A 17/38* (2013.01); *F41A 19/11* (2013.01)
USPC ..... 42/6; 42/7

(58) Field of Classification Search
CPC ..... F41A 17/38; F41A 35/06; F41A 9/00; F41A 9/55; F41A 19/11
USPC ..... 42/6, 7
See application file for complete search history.

(56) References Cited

U.S. PATENT DOCUMENTS

| | | | | |
|---|---|---|---|---|
| 2,125,350 | A * | 8/1938 | Loomis | 42/69.02 |
| 2,997,803 | A * | 8/1961 | Florence | 42/18 |
| 3,568,348 | A * | 3/1971 | Wilhelm | 42/7 |
| 4,237,638 | A * | 12/1980 | Trexler | 42/6 |
| 4,326,353 | A * | 4/1982 | Ludwig et al. | 42/7 |
| 5,566,487 | A * | 10/1996 | Vaid et al. | 42/7 |
| 5,628,134 | A * | 5/1997 | Wesp et al. | 42/7 |
| 2006/0265925 | A1 * | 11/2006 | Murello | 42/70.01 |
| 2010/0242329 | A1 * | 9/2010 | Carr et al. | 42/14 |
| 2010/0269390 | A1 * | 10/2010 | LaTorre et al. | 42/49.01 |
| 2011/0232148 | A1 * | 9/2011 | Cain et al. | 42/6 |
| 2012/0137556 | A1 * | 6/2012 | Laney et al. | 42/6 |

* cited by examiner

*Primary Examiner* — Bret Hayes
(74) *Attorney, Agent, or Firm* — Gudrun E. Huckett

(57) ABSTRACT

A metal lower receiver for a firearm has a receiver body. A magazine receptacle is disposed in the receiver body and adapted to receive a removable cartridge magazine. A magazine securing lever is disposed on the receiver body. The receiver body has a feed ramp positioned at a slant relative to a barrel of the firearm. The feed ramp is adapted to lift during reloading of the firearm a projectile tip of a cartridge from a removable cartridge magazine inserted into the magazine receptacle and to guide the cartridge in a direction of a cartridge chamber disposed in the barrel.

15 Claims, 4 Drawing Sheets

TRIGGER FOR FIREARMS WITH REMOVABLE MAGAZINE

BACKGROUND OF THE INVENTION

The invention relates to a lower receiver for firearms with removable cartridge magazine, especially for repeater rifles.

The following types of lower receivers for firearms, preferably repeater rifles, with removable cartridge magazine are known:

- lower receivers made of metal or plastic material;
- lower receivers without a distinct feed ramp;
- lower receivers with projecting unprotected magazine securing levers;
- lower receivers with magazine securing levers made of metal;
- lower receivers with magazine securing levers that have only one spring or spring bore or have a spring leg that is wound about the axis, wherein the actuating force cannot be adjusted by the user;
- lower receivers with a magazine receptacle without the possibility of adjusting by means of screws the play between cartridge magazine and lower receiver;
- lower receivers with magazine receptacle arranged centrally relative to the symmetry axis.

It is an object of the present invention to improve a lower receiver for a firearm with removable cartridge magazine of any of the aforementioned kinds.

SUMMARY OF THE INVENTION

Some modern firearms, in particular repeater rifles, have a lower receiver and a cartridge magazine of plastic material. Under load and with increasing age, lower receivers of plastic material have the tendency to break at the screw connections where they are attached at the stock/housing.

This problem is solved by producing the lower receiver of metal. According to the invention, it is achieved that in particular at the screw connections no stress cracks in the material are generated anymore.

lower receivers for firearms, in particular repeater rifles, with removable cartridge magazine have no feed ramp in order to guide the cartridges upon reloading into the cartridge chamber of the weapon. Either this feed ramp is integrally formed on the weapon housing or on the plastic cartridge magazine, as in the case of repeater rifles of the type Steyr Mannlicher Mod. "L-"M"-"S"-"XL" and Steyr SSG69. However, when it is desired to employ conventional commercially available metal cartridge magazines without feed ramp in these repeater rifles, this is not possible because on the weapon housing there is no feed ramp and commercially available metal cartridge magazines have no feed ramp so that the cartridges upon reloading are not guided into the cartridge chamber; this causes malfunction.

In accordance with the present invention, this problem is solved in that the lower receiver is provided with a distinct feed ramp positioned at a slant; the feed ramp during reloading lifts at a ramp angle Alpha the tip of the cartridge from the cartridge magazine and therefore guides the cartridge in the direction of the cartridge chamber of the rifle barrel. The cartridge magazine in this context is preferably a conventional commercially available metal cartridge magazine.

With the invention, it is thus achieved that in case of a repeater rifle, such as those of the type Steyr Mannlicher Mod. "L-"M"-"S"-"XL" and Steyr SSG69, a conventional commercially available metal cartridge magazine can be used.

A lower receiver with removable cartridge magazine has a magazine securing lever with an actuating section that can be operated by a finger and this actuating section is normally of a length of 1 cm to 2 cm; this actuating section normally projects from the lower receiver in order to be able to operate it easily by hand. By pressing down this lever, the locking mechanism is released and the cartridge magazine can be removed. These projecting levers have however the disadvantage that, when in use during hunting or in a police/military mission, they can catch on objects and can thus be accidentally actuated. In an extreme case, a cartridge magazine is lost without this being noticed and thus the contained ammunition is lost also.

This problem is solved in that the lower receiver has a magazine securing lever whose actuating section that is to be actuated by one finger is arranged in a protected position in a preferably semi-circular depression of the receiver body and is thus protected from accidental actuation. This embodiment achieves that the magazine securing (and release) lever can no longer be actuated accidentally.

Magazine securing levers are normally produced of metal and are spring-loaded against the metal cartridge magazine. Metals are not corrosion-resistant and corroded magazine securing levers can cause malfunction. Also, upon introduction of the cartridge magazine the metal surface of the magazine securing lever rubs on the metal cartridge magazine and can therefore damage the protective surface so that corrosion may occur at the now unprotected location of the cartridge magazine.

This problem is solved in that the magazine securing lever is produced of the high-strength plastic material polyoxymethylene, also known by the abbreviation POM or the name DELRIN®; this material can be machined easily by cutting.

With this embodiment, it is achieved that the magazine securing lever as a result of the employed material (the high-strength plastic material polyoxymethylene which can be easily machined by cutting) cannot corrode so that malfunction caused by corrosion can be prevented accordingly. At the same time, surface damage is prevented at the metal cartridge magazine and thus the generation of partial corrosion.

Magazine securing levers have normally a pressure spring or a leg spring for spring action relative to the cartridge magazine. The actuation force cannot be adjusted but is predetermined by the construction of the device.

This problem is solved in that the magazine securing lever has at least two bores for coil pressure springs. The bores should preferably have different effective distances relative to the axis of rotation in order to be able to influence the release force of the magazine securing lever by mounting the spring in different positions or by mounting two springs so that the release force can be adjusted individually. With this embodiment, it is achieved that the actuation force of the magazine securing level lever can be adjusted individually to the needs of the user.

In order for the cartridge magazine to be easily introduced into and removed from the magazine receptacle, play must be provided. Also, manufacturing tolerances between cartridge magazine and magazine receptacle may exist so that the metal cartridge magazine will always slightly rattle in a metal lower receiver. This noise is undesirable when hunting or when on a police or military mission. Elements for adjusting this play for noise reduction are not known in the art.

According to the present invention, this problem is solved in that, perpendicular to an insertion direction of a cartridge magazine into the magazine receptacle, at least two continuous threaded bores are provided in which set screws are seated with which the play between the cartridge magazine and the receiver body (magazine receptacle provided therein) can be adjusted. With this embodiment, it is achieved that the play of the cartridge magazine in the magazine receptacle of the lower receiver can be adjusted by set screws individually and disruptive rattle noise can be reduced to a minimum.

Modern cartridge magazines of firearms are produced of plastic material in order to reduce costs. However, these plastic cartridge magazines, due to the high forces of the magazine spring, in particular at the magazine lips, have the tendency to wear easily. Multi-part cartridge magazine configuration as they are known from the repeater rifles of the type Steyr Mannlicher Mod. "L-"M"-"S"-"XL" and Steyr SSG69 have the tendency to expand at the connection points so that a reliable function is no longer ensured. Repeater rifles of the type Steyr Mannlicher Mod. "L-"M"-"S"-"XL" and Steyr SSG69 have a cartridge magazine with rotary cartridge arrangement and with eccentric feed relative to the axis of symmetry of the weapon. This basic construction makes it impossible to employ a conventional and commercially available durable metal cartridge magazine that can be arranged centrally relative to the longitudinal symmetry axis of the weapon.

This problem is solved in that the longitudinal symmetry axis of the magazine receptacle is eccentric to the longitudinal symmetry axis of the lower receiver and therefore relative to the remainder of the weapon (length of the weapon); the cartridge magazine, which is preferably a commercially available metal cartridge magazine, can adjust to the eccentric shape of the weapon housing of repeater rifles, originally provided with plastic rotary cartridge magazines with eccentric cartridge feed as is known from the type Steyr Mannlicher Mod. "L-"M"-"S"-"XL" and Steyr SSG69, without having to rework the weapon.

With the invention according to this embodiment, it is achieved that repeater rifles with rotary cartridge arrangement and eccentrically arranged feed relative to the symmetry axis of the weapon, as in the type Steyr Mannlicher Mod. "L-"M"-"S"-"XL" and Steyr SSG69, can be retrofitted with a conventionally durable metal cartridge magazine.

BRIEF DESCRIPTION OF THE DRAWINGS

One embodiment of the invention is disclosed in FIGS. 1 through 8.

DESCRIPTION OF THE PREFERRED EMBODIMENTS

Figure 1:
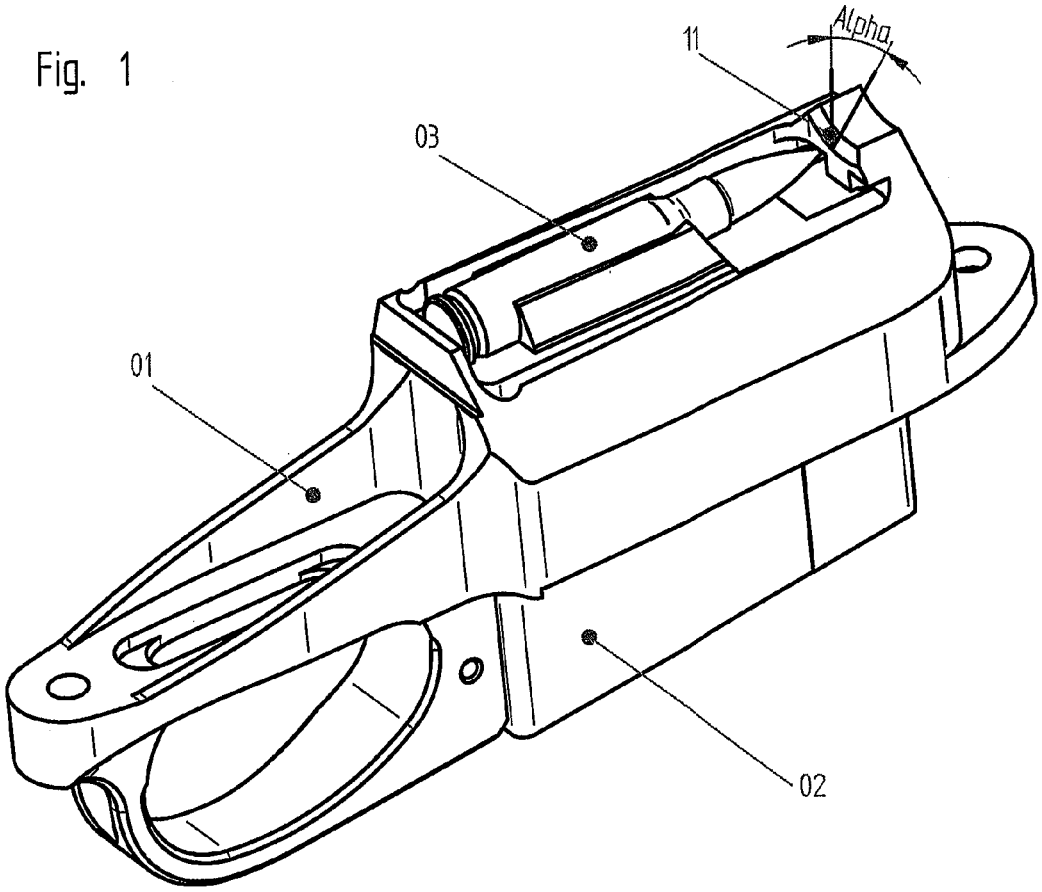
FIG. 1 shows in a perspective view the lower receiver with inserted cartridge magazine with one cartridge being shown at the top.

FIG. 1 shows the lower receiver 01 with its receiver body and with an inserted cartridge magazine 02 in which a cartridge 03 is shown. Also visible is the feed ramp 11 which, upon reloading, guides the uppermost cartridge 03 across the feed ramp 11 provided with a ramp angle Alpha in the direction of the cartridge chamber of the rifle barrel.

Figure 2:
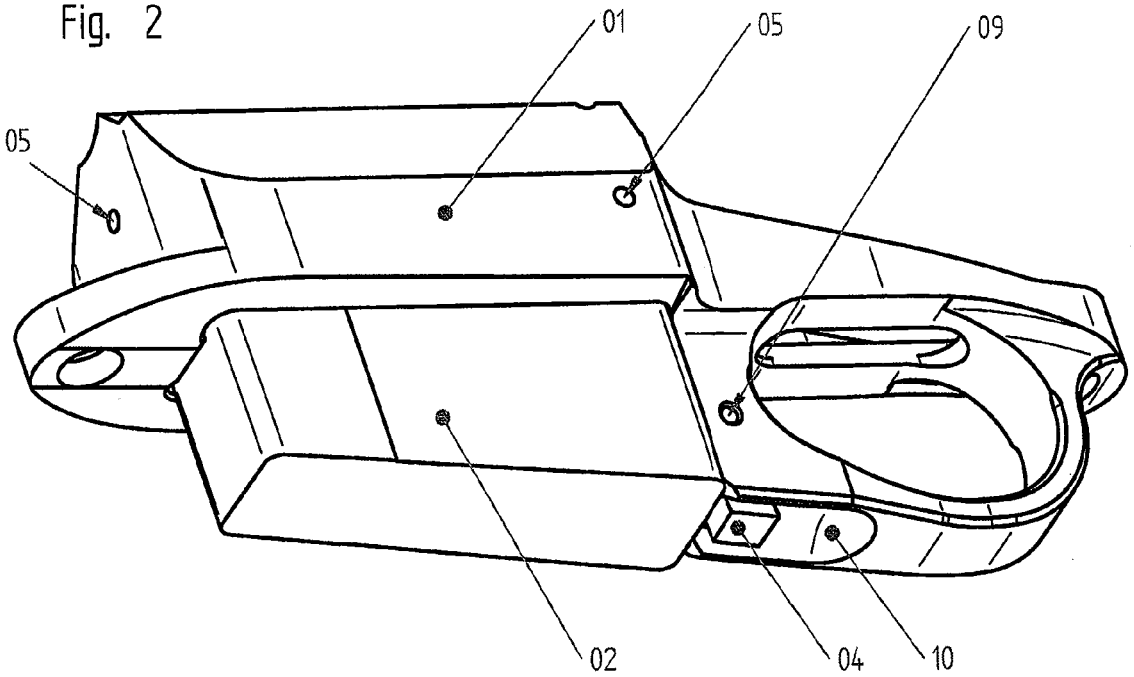
FIG. 2 shows a perspective view of the bottom side of the lower receiver with threaded bores in which set screws are arranged for adjustment of play between cartridge magazine and lower receiver.

FIG. 2 shows the lower receiver 01 with threaded bores 05 in which set screws are seated that are used for adjusting the play between the lower receiver 01 and the cartridge magazine 02. The cartridge magazine 02 is secured in its position by the magazine securing lever 04. The magazine securing lever 04 that is supported on the receiver body so as to be rotatable about axis 09 is located in a recessed, preferably semi-circular, depression 10 and can therefore not be accidentally actuated.

Figure 3:
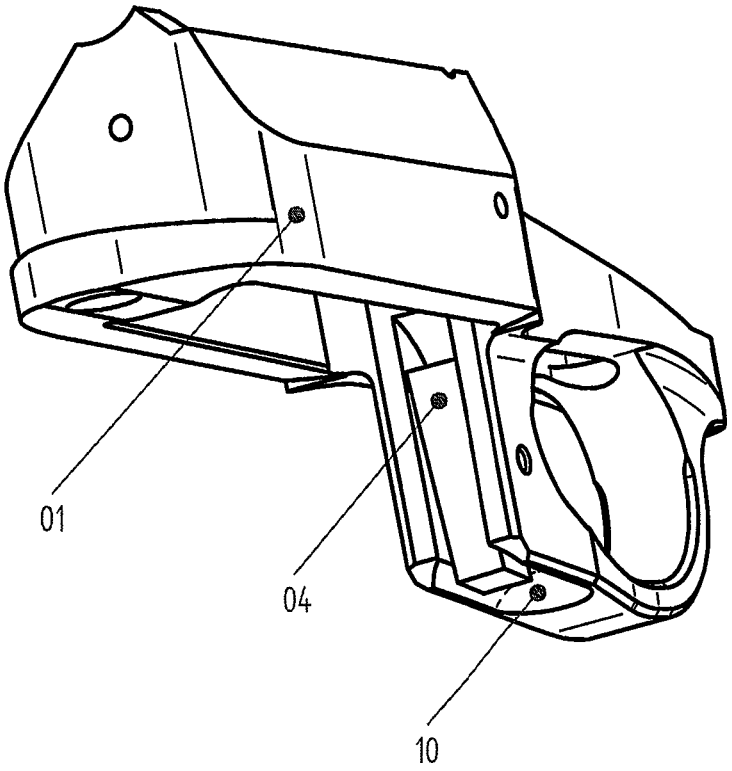
FIG. 3 shows in a perspective view the lower receiver with removed cartridge magazine exposing the magazine securing lever mounted in the lower receiver.

FIG. 3 shows the magazine securing lever 04 which is mounted on the receiver body of the lower receiver 01 and has an actuating section that is located in a recessed, preferably semi-circular depression 10, and therefore cannot be actuated accidentally.

Figure 4:
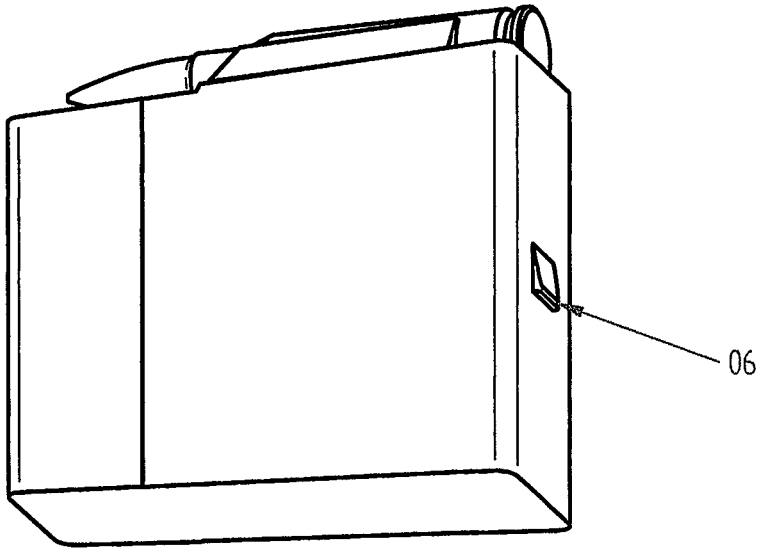
FIG. 4 shows the cartridge magazine with catch.

FIG. 4 shows the cartridge magazine with the projection or catch 06; the cartridge magazine is positioned at the contact location within the lower receiver 01 by means of the magazine securing lever 04.

Figure 5:
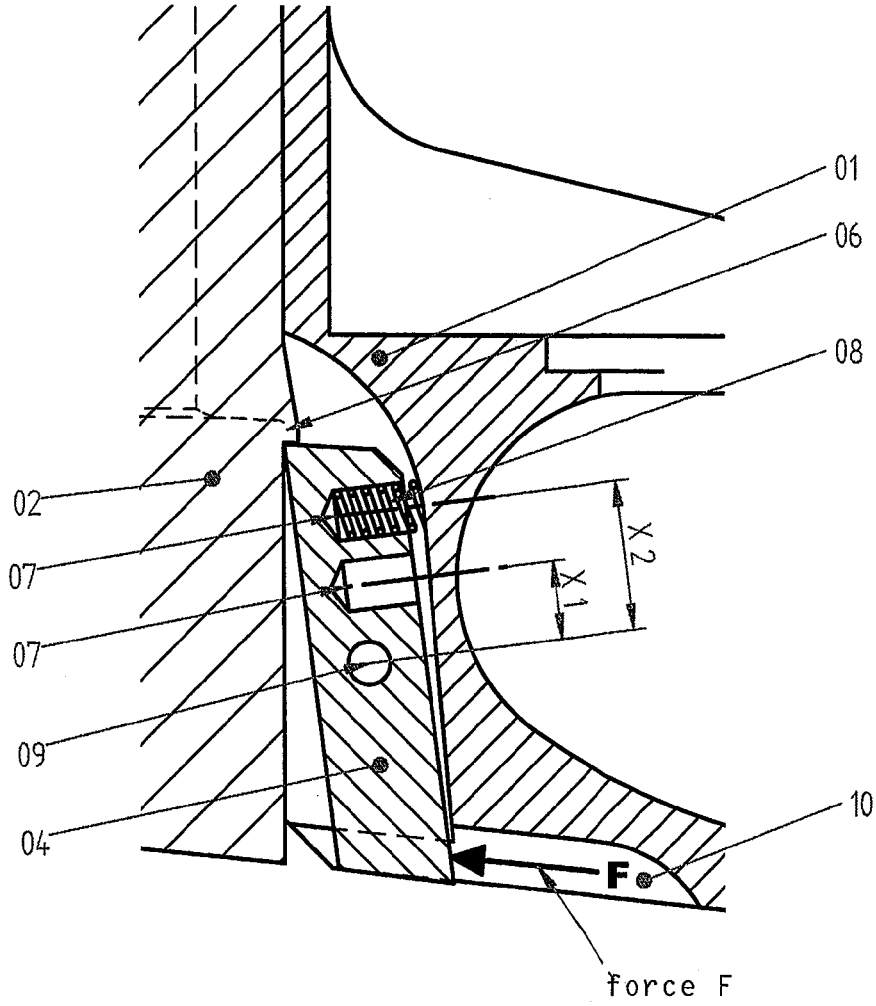
FIG. 5 shows in section a detail view of the magazine securing lever positioning the cartridge magazine in the lower receiver at the contact location with the catch.

FIG. 5 shows the magazine securing lever 04 that positions the cartridge magazine 02 in the lower receiver 01 at the contact location relative to the projection 06. The magazine securing lever 04 that is rotatably supported so as to rotate about axis 09 is positioned in a recessed, preferably semi-circular, depression 10, and can therefore not be accidentally actuated.

The magazine securing lever 04 has preferably at least two bores 07 in which a spring 08 is seated. As a result of different effective distances X1 and X2 relative to axis 09, the actuation force F for the magazine securing lever 04 can be affected with a simple repositioning of the spring 08 into a different bore. Also, it is possible to mount two springs in order to increase the force. In this way, the actuation force F can be varied with simple means.

Figure 6:
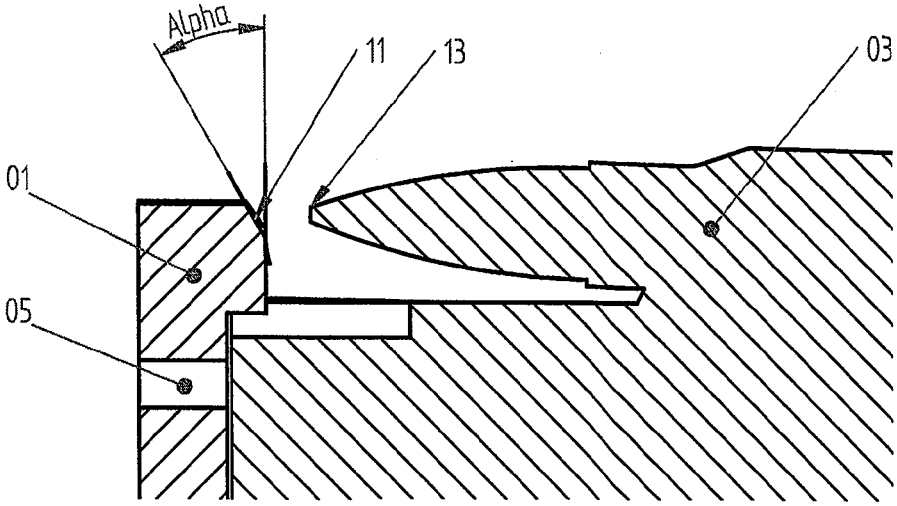
FIG. 6 shows the feed ramp of the lower receiver with ramp angle Alpha.

FIG. 6 shows the feed ramp 11 of the receiver body of the lower receiver 01 wherein the feed ramp 11 is positioned at a slant with ramp angle Alpha. The ramp angle Alpha must be at least somewhat greater than the static friction limit angle, preferably however greater than, for example, 30°-45°.

Upon reloading, the cartridge 03 is moved in the firing direction and the tip 13 of the projectile is lifted across the surface of the feed ramp 11 with the ramp angle Alpha and is guided in the direction of the cartridge chamber.

Figure 7:
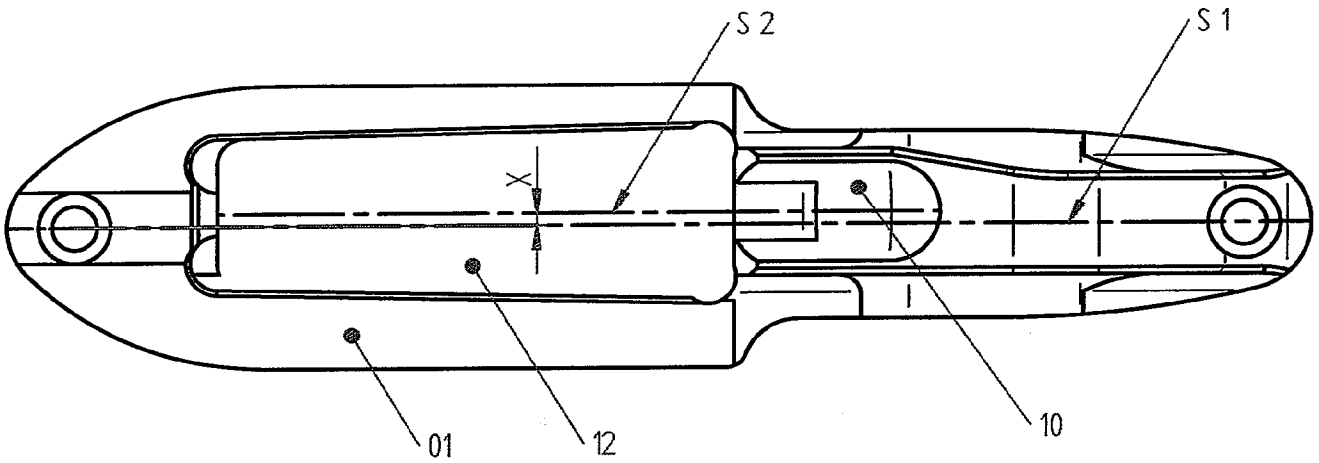
FIG. 7 shows a bottom plan view of the lower receiver.
Figure 8:
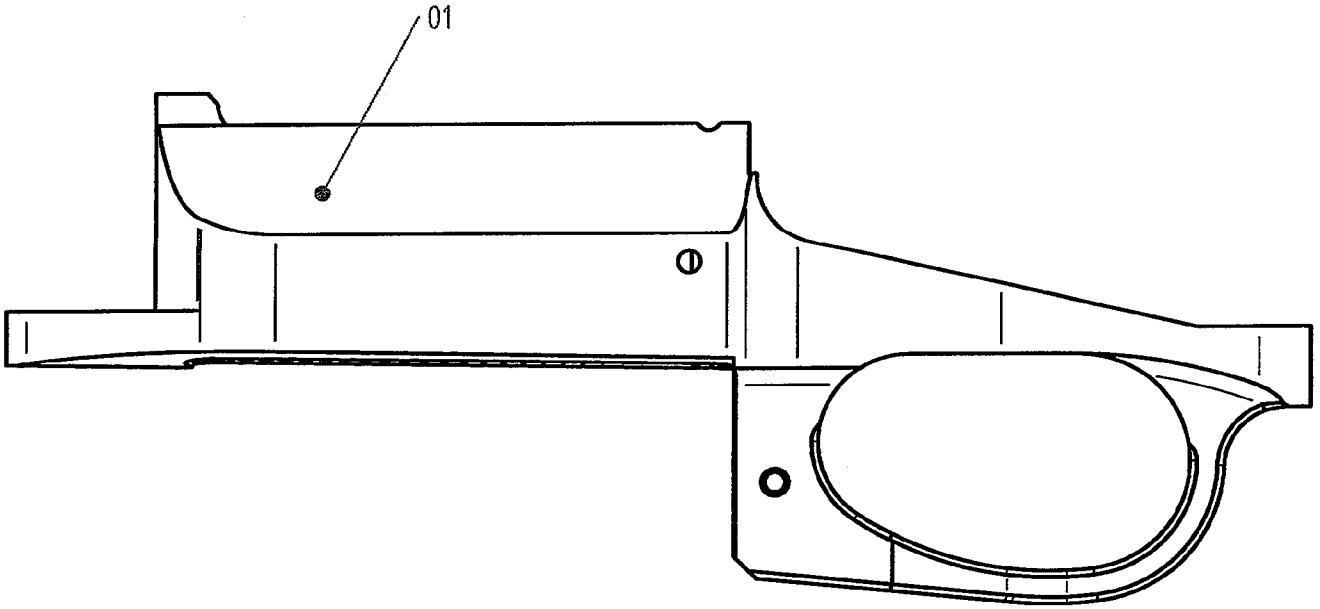
FIG. 8 shows a side view of the lower receiver without cartridge magazine.

FIG. 7 shows the lower receiver 01 with eccentrically arranged magazine receptacle 12 that is eccentric to the longitudinal axis of symmetry S1. Because of the eccentric arrangement, the cartridge magazine 02, which is preferably a conventional commercially available metal cartridge magazine, is displaced by the distance X eccentrically to the longitudinal axis of symmetry of the weapon in the receiver body in order to be adjusted or matched in this way to the eccentrically designed weapon housing as provided, for example, in the repeater rifles of the type Steyr Mannlicher Mod. "L-"M"-"S"-"XL" and Steyr SSG69.

The specification incorporates by reference the entire disclosure of German priority document 20 2012 008 104 U1 having a filing date of Aug. 24, 2012.

While specific embodiments of the invention have been shown and described in detail to illustrate the inventive principles, it will be understood that the invention may be embodied otherwise without departing from such principles.

REFERENCE NUMERALS

01 lower receiver
02 cartridge magazine

03 cartridge
04 magazine securing lever
05 threaded bore for a set screw
06 projection/catch on the cartridge magazine
07 bore
08 coil pressure spring
09 axis of rotation of the magazine securing lever
10 semi-circular depression
11 feed ramp
12 magazine receptacle
13 projectile tip
Alpha ramp angle of the feed ramp (preferably 30 to 45°)
S1 symmetry axis of the lower receiver/firearm
S2 symmetry axis of the magazine receptacle
X distance of the eccentric arrangement of the magazine receptacle 12 in the lower receiver 01
X1 effective distance of the coil pressure spring/bore to the axis of rotation 09
X2 effective distance of the coil pressure spring/bore to the axis of rotation 09

What is claimed is:

1. A metal lower receiver for a firearm comprising:
a receiver body;
a magazine receptacle disposed in the receiver body and adapted to receive a removable cartridge magazine;
a magazine securing lever disposed on the receiver body;
the receiver body having a feed ramp positioned at a slant relative to a barrel of the firearm;
wherein the feed ramp is adapted to lift, during reloading of the firearm, a projectile tip of a cartridge from a removable cartridge magazine inserted into the magazine receptacle and to guide the cartridge in a direction of a cartridge chamber disposed in the barrel of the firearm,
wherein the receiver body has a depression and wherein the magazine securing lever has an actuating section that is positioned in the depression of the receiver body and is protected from accidental actuation;
wherein the magazine securing lever is provided with bores, wherein the bores each have a different effective spacing relative to an axis of rotation of the magazine securing lever, wherein by applying a release force on the magazine securing lever a cartridge magazine inserted into the magazine receptacle is released, wherein the release force causes the magazine securing lever to rotate about the axis of rotation, and wherein the release force is adjusted by mounting a coil pressure spring in one of said bores or by mounting a coil spring in each one of said bores, respectively.

2. The metal lower receiver according to claim 1, wherein the depression is of a semi-circular shape.

3. The metal lower receiver according to claim 1, wherein the magazine securing lever is made of high-strength, easily machinable POM (polyoxymethylene).

4. A metal lower receiver for a firearm comprising:
a receiver body;
a magazine receptacle disposed in the receiver body and adapted to receive a removable cartridge magazine;
a magazine securing lever disposed on the receiver body;
the receiver body having a feed ramp positioned at a slant relative to a barrel of the firearm;
wherein the feed ramp is adapted to lift, during reloading of the firearm, a projectile tip of a cartridge from a removable cartridge magazine inserted into the magazine receptacle and to guide the cartridge in a direction of a cartridge chamber disposed in the barrel of the firearm;
wherein the receiver body has a depression and wherein the magazine securing lever has an actuating section that is positioned in the depression of the receiver body and is protected from accidental actuation;
wherein, perpendicular to an insertion direction of a cartridge magazine into the magazine receptacle, at least two continuous bores are provided and set screws are seated in the at least two continuous bores, wherein play between a cartridge magazine inserted into the magazine receptacle and the magazine receptacle is adjusted by the set screws.

5. The metal lower receiver according to claim 4, wherein the depression is of a semi-circular shape.

6. The metal lower receiver according to claim 4, wherein the magazine securing lever is made of high-strength, easily machinable POM (polyoxymethylene).

7. A metal lower receiver for a firearm comprising:
a receiver body;
a magazine receptacle disposed in the receiver body and adapted to receive a removable cartridge magazine;
a magazine securing lever disposed on the receiver body;
the receiver body having a feed ramp positioned at a slant relative to a barrel of the firearm;
wherein the feed ramp is adapted to lift, during reloading of the firearm, a projectile tip of a cartridge from a removable cartridge magazine inserted into the magazine receptacle and to guide the cartridge in a direction of a cartridge chamber disposed in the barrel of the firearm;
wherein the receiver body has a depression and wherein the magazine securing lever has an actuating section that is positioned in the depression of the receiver body and is protected from accidental actuation;
wherein a longitudinal axis of symmetry of the magazine receptacle extending in a longitudinal direction of the firearm is eccentric to a longitudinal symmetry axis of the metal lower receiver extending in the longitudinal direction of the firearm, wherein a cartridge magazine is adjustable to an eccentric shape of a firearm housing of repeater rifles, provided originally with plastic rotary magazines with eccentric cartridge feed, without reworking the firearm.

8. The metal lower receiver according to claim 7, wherein the depression is of a semi-circular shape.

9. The metal lower receiver according to claim 7, wherein the magazine securing lever is made of high-strength, easily machinable POM (polyoxymethylene).

10. A metal lower receiver, for a firearm comprising:
a receiver body;
a magazine receptacle disposed in the receiver body and adapted to receive a removable cartridge magazine;
a magazine securing lever disposed on the receiver body;
the receiver body having a feed ramp positioned at a slant relative to a barrel of the firearm;
wherein the feed ramp is adapted to lift, during reloading of the firearm, a projectile tip of a cartridge from a removable cartridge magazine inserted into the magazine receptacle and to guide the cartridge in a direction of a cartridge chamber disposed in the barrel of the firearm;
wherein the magazine securing lever is provided with bores, wherein the bores each have a different effective spacing relative to an axis of rotation of the magazine securing lever, wherein by applying a release force on the magazine securing lever a cartridge magazine inserted into the magazine receptacle is released, wherein the release force causes the magazine securing lever to rotate about the axis of rotation, and wherein the release force is adjusted by mounting a coil pressure spring in one of said bores or by mounting a coil spring in each one of said bores, respectively.

11. The metal lower receiver according to claim 10, wherein the magazine securing lever is made of high-strength, easily machinable POM (polyoxymethylene).

12. A metal lower receiver, for a firearm comprising:

a receiver body;

a magazine receptacle disposed in the receiver body and adapted to receive a removable cartridge magazine;

a magazine securing lever disposed on the receiver body;

the receiver body having a feed ramp positioned at a slant relative to a barrel of the firearm;

wherein the feed ramp is adapted to lift, during reloading of the firearm, a projectile tip of a cartridge from a removable cartridge magazine inserted into the magazine receptacle and to guide the cartridge in a direction of a cartridge chamber disposed in the barrel of the firearm;

wherein, perpendicular to an insertion direction of a cartridge magazine into the magazine receptacle, at least two continuous bores are provided and set screws are seated in the at least two continuous bores, wherein play between a cartridge magazine inserted into the magazine receptacle and the magazine receptacle is adjusted by the set screws.

13. The metal lower receiver according to claim 12, wherein the magazine securing lever is made of high-strength, easily machinable POM (polyoxymethylene).

14. A metal lower receiver, for a firearm comprising:

a receiver body;

a magazine receptacle disposed in the receiver body and adapted to receive a removable cartridge magazine;

a magazine securing lever disposed on the receiver body;

the receiver body having a feed ramp positioned at a slant relative to a barrel of the firearm;

wherein the feed ramp is adapted to lift, during reloading of the firearm, a projectile tip of a cartridge from a removable cartridge magazine inserted into the magazine receptacle and to guide the cartridge in a direction of a cartridge chamber disposed in the barrel of the firearm;

wherein a longitudinal axis of symmetry of the magazine receptacle extending in a longitudinal direction of the firearm is eccentric to a longitudinal symmetry axis of the metal lower receiver extending in the longitudinal direction of the firearm, wherein a cartridge magazine is adjustable to an eccentric shape of a firearm housing of repeater rifles, provided originally with plastic rotary magazines with eccentric cartridge feed, without reworking the firearm.

15. The metal lower receiver according to claim 14, wherein the magazine securing lever is made of high-strength, easily machinable POM (polyoxymethylene).

* * * * *